United States Patent [19]

Kamakura et al.

[11] Patent Number: 5,032,305

[45] Date of Patent: Jul. 16, 1991

[54] LUBRICANT FOR REFRIGERANT

[75] Inventors: Tamiji Kamakura; Yuzi Baba; Kimiyoshi Namiwa, all of Tokyo, Japan

[73] Assignee: Asahi Denka Kogyo K.K., Tokyo, Japan

[21] Appl. No.: 509,632

[22] Filed: Apr. 13, 1990

[30] Foreign Application Priority Data

May 31, 1989 [JP] Japan ..... 1-138026

[51] Int. Cl.[5] ..... C09K 5/00; C10M 105/08

[52] U.S. Cl. ..... 252/67; 252/68; 252/32; 252/52 A; 252/52 R; 252/51.5 A; 252/51.5 R; 260/404; 568/601; 568/613; 568/672

[58] Field of Search ..... 252/67, 32, 68, 52 A, 252/52 R, 51.5 A, 51.5 R; 260/404; 568/601, 613, 672

[56] References Cited

U.S. PATENT DOCUMENTS

| | | | |
|---|---|---|---|
| 2,717,242 | 9/1955 | Foehr | 252/49.6 |
| 2,796,423 | 6/1957 | Cottle et al. | 260/410.9 |
| 2,801,968 | 8/1957 | Furby et al. | 252/32.5 |
| 2,839,468 | 6/1958 | Stewart et al. | 252/32.5 |
| 4,301,083 | 11/1981 | Yoshimura et al. | 260/404 |
| 4,755,316 | 7/1988 | Magid et al. | 252/68 |
| 4,851,144 | 7/1989 | McGraw et al. | 252/52 A |
| 4,898,992 | 2/1990 | Stankowiak et al. | 568/672 |

FOREIGN PATENT DOCUMENTS

| | | |
|---|---|---|
| 0017072 | 10/1980 | European Pat. Off. . |
| 2943446 | 5/1980 | Fed. Rep. of Germany . |

*Primary Examiner*—Paul Lieberman
*Assistant Examiner*—William S. Parks
*Attorney, Agent, or Firm*—Flynn, Thiel, Boutell & Tanis

[57] ABSTRACT

A lubricant composition for refrigerators using Flon 134a comprises at least 80 percent by weight of a specific type of polyoxethylene glycol dialkyl ether having a kinematic viscosity of 6 to 500 cSt at 40 degree centigrade.

10 Claims, No Drawings

LUBRICANT FOR REFRIGERANT

The present invention relates to a lubricant for refrigerators. Particularly, it relates to a polyoxyalkylene glycol lubricant for refrigerators which is well compatible with a flon used in a refrigerator.

PRIOR ART

Flon compounds are excellent materials in the respects of chemical stability, low toxicity and incombustibility, so they have been widely used in the fields of refrigerants, aerosols, foaming, cleaning and so on. Recently, however, there has been a strong movement for the reduction in the production and consumption of specific kinds of flons, because the flons emitted into the open air not only destroy the ozonosphere but also cause the warming of the earth's surface, the so-called "greenhouse effect".

Accordingly, the development of a flon which is free from the danger of causing the destruction of the ozonosphere or the greenhouse effect, i.e., a flon which does not contain any chlorine atoms and is relatively easily decomposable is in progress.

Under these circumstances, Flon 134*a* (1,1,1,2-tetrafluoroethane) has been developed as a substitute for Flon 12 (dichlorodifluoromethane) and has been widely used as the refrigerant in domestic refrigerators, air conditioners, small-sized refrigerators for business use, automotive air conditioners and so on, because the characteristics of Flon 134*a* is similar to those of Flon 12.

However, Flon 134*a* is poor in compatibility with a naphthenic mineral oil or alkylbenzene which has been used as a refrigerator oil and cause troubles such as lowering the reversion in an evaporator, seizing of a compressor or abnormal vibration. Thus, it has been sought to develop a refrigerator oil which is compatible with Flon 134*a*.

U.S. Pat. No. 4755316 proposed a difunctional or higher polyoxyalkylene glycol having a molecular weight of 2,000 or below as an oil for a refrigerator using Flon 134*a* as a refrigerant. However, this oil is so hygroscopic that the water absorbed by the oil causes a failure in the actuation of an expansion valve of a refrigerator or blockage (water choking) thereof or accelerates the decomposition of the flon to form hydrofluoric acid which presents the danger of corroding the metal part.

SUMMARY OF THE INVENTION

The inventors of the present invention have intensively studied various synthetic lubricants and have found that a specific kind of polyoxyalkylene glycol dialkyl ether is compatible not only with conventional flon refrigerants but also with Flon 134*a* and has reduced hygroscopicity and excellent inertness to flons. The present invention has been accomplished on the basis of this finding.

Namely, the lubricant for refrigerators according to the present invention is characterized by containing at least 80% by weight of a compound represented by the general formula (1):

$$C_mH_{2m+1}O(\overset{\overset{\displaystyle CH_3}{|}}{CH_2CHO})_p(CH_2CH_2O)_q(CH_2O)_rC_nH_{2n+1} \quad (1)$$

wherein m represents an integer of 1 to 8, n represents an integer of 1 to 8, p represents an integer of 1 to 80, q represents an integer of 0 to 60 and r represents 0 or 1, with the proviso that the relationships:

$$2 \leqq m+n \leqq 9$$

and $$-8 < m + n - \frac{20 \times q}{p+q} < 4$$

are both satisfied, and by exhibiting a kinematic viscosity of 6 to 500 cSt at 40° C.

The invention provides a lubricant composition for refrigerators comprising at least 80 percent by weight of a compound having the formula (1), having a kinematic viscosity of 6 to 500 cSt at 40 degree centigrade.

It is preferable that the composition comprises at least 80 percent by weight of the compound and up to 20 percent by weight of an additive.

The invention provides a refrigerant composition comprising the compound above and Flon 134*a*.

In the above general formula (1), the $$(\overset{\overset{\displaystyle CH_3}{|}}{CH_2CHO}),\ (CH_2CH_2O) \text{ and } (CH_2O)$$

units may be each arranged as blocks or at random.

Examples of the alkyl group represented by the formula are: $C_mH_{2m+l}$ or $C_nH_{2n+l}$, including methyl, ethyl, 1-propyl, 2-propyl, 1-butyl, 2-butyl, 2-methyl-1-propyl, 2-methyl-2-propyl, 1-pentyl, 2-pentyl, 3-pentyl, 2-methyl-1-butyl, 3-methyl-1-butyl, 2-methyl-2-butyl, 1-hexyl, 4-methyl-2-pentyl, 2-ethyl-1-butyl, 1-heptyl, 2-heptyl, 3-heptyl, 1-octyl, 2-octyl and 2-ethylhexyl groups.

Among these groups, methyl, ethyl, 1-propyl, 1-butyl, 2-methyl-1-propyl and 2-ethylhexyl groups are preferred from the standpoint of the availability of the raw material.

Compounds represented by the above general formula wherein m or n is 0 are too hygroscopic to be used as a lubricant for refrigerators, while those represented by the general formula wherein m or n is 9 or above are unsuitable as a lubricant for refrigerators, because they separate from Flon 134*a* at a temperature of from −50° to 60° C., which corresponds to the practical service temperature of a lubricant for refrigerators, to cause various troubles.

Further, compounds represented by the above general formula wherein the relationships:

$$2 \leqq m + n \leqq 9 \text{ or } -8 < m + n - \frac{20 \times q}{p+q} < 4$$

are not satisfied also separate from Flon 134*a* at a temperature of −50° to 60° C. to cause various troubles.

The polyoxyalkylene glycol dialkyl ether according to the present invention can be prepared from raw materials such as alcohols and alkylene oxides by suitably combining ordinary addition, etherification and other reactions.

The lubricant for refrigerators according to the present invention must contain at least 80% by weight of a polyoxyalkylene glycol dialkyl ether represented by the above general formula (1) based on the whole composition in order to make the lubricant exhibit satisfactory performances.

Further, the lubricant for refrigerators according to the present invention must exhibit a kinematic viscosity of 6 to 500 cSt at 40° C. If the kinematic viscosity of the lubricant at 40° C. is less than 6 cSt, sufficient lubricity will not be attained, while if it exceeds 500 cSt, the load of the compressor will increase to bring about a disadvantage in energy consumption and reversion in the oil-separating pipe of a refrigerator will lower.

Although the lubricant for refrigerators according to the present invention may be composed of only a polyoxyalkylene glycol dialkyl ether represented by the above general formula (1), the lubricant can further contain additives which have been used in the lubricants for a refrigerator using a flon as a refrigerant in an amount as described above. The additives include phosphates such as tricresyl phosphate; phosphites such as triethyl phosphite; epoxy compounds such as epoxidized soybean oil and bisphenol A diglycidyl ether; organotin compounds such as dibutyltin laurate; and antioxidants such as α-naphthylbenzylamine, phenothiazine and BHT.

The lubricant for refrigerators according to the present invention and Flon 134*a* can be completely dissolved in each other at substantially any ratio (1:99 to 99:1) in the service temperature range of a refrigerator oil, i.e., in a temperature range of −50° to 60° C.

EFFECT OF THE INVENTION

The lubricant for refrigerators according to the present invention is very compatible with flons, particularly with Flon 134*a*, used in a refrigerator, so that the utilization thereof in a wide field of uses is expected.

EXAMPLE

The present invention will now be described in more detail by referring to the following Examples, though the present invention is not limited to them.

In the Examples, the following Samples 1 to 17 were examined for compatibility:

Sample 1

$$CH_3O(CH_2\overset{\overset{CH_3}{|}}{C}HO)_7CH_3$$

Sample 2

$$CH_3O(CH_2\overset{\overset{CH_3}{|}}{C}HO)_{17}CH_3$$

Sample 3

$$CH_3O(CH_2\overset{\overset{CH_3}{|}}{C}HO)_{69}CH_3$$

Sample 4

$$CH_3\overset{\overset{CH_3}{|}}{C}HO(CH_2\overset{\overset{CH_3}{|}}{C}HO)_{17}CH_3$$

Sample 5 (random polymer)

$$CH_3CH_2CH_2CH_2O(CH_2\overset{\overset{CH_3}{|}}{C}HO)_8(CH_2CH_2O)_{11}CH_3$$

-continued

Sample 6 (block polymer)

$$CH_3O(CH_2CH_2O)_5(CH_2\overset{\overset{CH_3}{|}}{C}HO)_{30}(CH_2CH_2O)_5CH_3$$

Sample 7 (random polymer)

$$CH_3CH_2CH_2CH_2\overset{\overset{CH_2CH_3}{|}}{C}HCH_2O(CH_2\overset{\overset{CH_3}{|}}{C}HO)_{15}(CH_2CH_2O)_{15}CH_3$$

Sample 8 (random polymer)

$$CH_3CH_2O(CH_2\overset{\overset{CH_3}{|}}{C}HO)_{10}(CH_2CH_2O)_{10}(CH_2O)_1CH_2CH_3$$

Sample 9

$$CH_3CH_2CH_2CH_2O(CH_2\overset{\overset{CH_3}{|}}{C}HO)_{18}CH_3$$

Sample 10 (random polymer)

$$CH_3CH_2CH_2CH_2\overset{\overset{CH_2CH_3}{|}}{C}HCH_2O(CH_2\overset{\overset{CH_3}{|}}{C}HO)_{34}(CH_2CH_2O)_{10}CH_3$$

Sample 11 (random polymer)

$$CH_3O(CH_2\overset{\overset{CH_3}{|}}{C}HO)_{17}(CH_2CH_2O)_{23}CH_3$$

Sample 12 (random polymer)

$$CH_3O(CH_2\overset{\overset{CH_3}{|}}{C}HO)_{21}(CH_2CH_2O)_{64}CH_3$$

Sample 13

$$HO(CH_2\overset{\overset{CH_3}{|}}{C}HO)_7H$$

Sample 14

$$CH_3O(CH_2\overset{\overset{CH_3}{|}}{C}HO)_7H$$

Sample 15

$$HO(CH_2\overset{\overset{CH_3}{|}}{C}HO)_{17}H$$

Sample 16

$$CH_3O(CH_2\overset{\overset{CH_3}{|}}{C}HO)_{17}H$$

Sample 17

$$CH_3\overset{\overset{CH_3}{|}}{C}HO(CH_2\overset{\overset{CH_3}{|}}{C}HO)_{17}H$$

EXAMPLE 1

Either 15 parts by weight of each of the samples listed in Table 1 and 85 parts by weight of each of the flons listed in Table 1 (case 1) or 60 parts by weight of each of the samples listed in Table 1 and 40 parts by weight of each of their flons listed in Table 1 (case 2) were fed into a 1-l autoclave made of glass to determine the compatibility at a temperature of −50° to 60° C.

The results are given in Table 1.

TABLE 1

| Sample No. | Kinematic viscosity at 40° C. (cSt) | m + n | m + n − (20 × q)/(p + q) | Flon 12 | Flon 22 | Flon 134a |
|---|---|---|---|---|---|---|
| 1 | 6.4 | 2 | 2.0 | completely dissolved | completely dissolved | completely dissolved |
| 2 | 33 | 2 | 2.0 | completely dissolved | completely dissolved | completely dissolved |
| 3 | 210 | 2 | 2.0 | completely dissolved | completely dissolved | completely dissolved |
| 4 | 35 | 4 | 4.0 | completely dissolved | completely dissolved | completely dissolved |
| 5 | 38 | 5 | −6.6 | completely dissolved | completely dissolved | completely dissolved |
| 6 | 160 | 2 | −3.0 | completely dissolved | completely dissolved | completely dissolved |
| 7 | 77 | 9 | −1.0 | completely dissolved | completely dissolved | completely dissolved |
| 8 | 41 | 4 | −6.0 | completely dissolved | completely dissolved | completely dissolved |

Note
Flon 22: monochlorodifluoromethane

COMPARATIVE EXAMPLE 1

The samples listed in Table 2 were examined for compatibility in a similar manner to that of case 1 of Example 1. The results are given in Table 2.

TABLE 2

| Sample No. | Kinematic viscosity at 40° C. (cSt) | m + n | m + n − (20 × q)/(p + q) | Flon 12 | Flon 22 | Flon 134a |
|---|---|---|---|---|---|---|
| 9 | 45 | 5 | 5 | completely disssolved | completely dissolved | separated into two layers at −30° C. or below |
| 10 | 176 | 9 | 4.5 | completely disssolved | completely dissolved | separated into two layers at −30° C. or below |
| 11 | 114 | 2 | −9.5 | completely disssolved | completely dissolved | separated into two layers at −40° C. or below |
| 12 | 470 | 2 | −13.1 | completely disssolved | completely dissolved | separated into two layers at 20° C. or above |

EXAMPLE 2

10 g of each of samples listed in Table 3 was put in a 100-ml beaker and the beaker was placed in a thermo-hygrostat to determine the weight change after 24 hours.

The results are given in Table 3.

TABLE 3

| Sample No. | Wt. before test (g) | Wt. after test (g) | Wt. increase (mg) |
|---|---|---|---|
| 1 | 10.0000 | 10.0156 | 15.6 |
| 2 | 10.0003 | 10.0136 | 13.4 |
| 4 | 10.0001 | 10.0123 | 12.2 |

COMPARATIVE EXAMPLE 2

The samples listed in Table 4 were examined for hygroscopicity in a similar manner to that of Example 2. The results are given in Table 4.

As shown in Table 4, the samples exhibit weight increases larger than those of the samples of Example 2, i.e., the samples are more hygroscopic than those of Example 2.

TABLE 4

| Sample No. | Wt. before test (g) | Wt. after test (g) | Wt. increase (mg) |
|---|---|---|---|
| 13 | 10.0000 | 10.6091 | 609.1 |
| 14 | 10.0002 | 10.2239 | 223.7 |
| 15 | 10.0002 | 10.1614 | 161.2 |
| 16 | 10.0000 | 10.1278 | 127.8 |
| 17 | 10.0001 | 10.1214 | 121.3 |

EXAMPLE 3

14 parts by weight of a sample (No. 1, 2 or 4) listed in Table 5, 0.7 part by weight of dibutyltin laurate (Mark BT-11, a product of Adeka Argus) and 0.3 part by weight of an epoxidized soybean oil (Adekacizer 0-130P, a product of Adeka Argus) were put in a 100-ml autoclave made of stainless steel (SUS-316) to prepare a lubricant for refrigerators. This lubricant was examined for viscosity and appearance before the test. Then, 75 parts by weight of Flon 22 was introduced into the autoclave and three metal pieces (50×25×1.5 mm) respectively made of steel, copper or aluminum were placed in the autoclave. After hermetically sealing the autoclave, the contents were kept at 150° C. by heating for 14 days (336 hours) to carry out a heat test. After the completion of the heat test, the autoclave was subjected to vacuum deaeration to remove the Flon 22 and the resulting lubricant was examined for viscosity and appearance after the test. Further, the metal pieces were washed with toluene and ethanol to determine the weight change thereof.

It is apparent from the test results that the lubricants for refrigerators according to the present invention exhibit a viscosity change of −10 to −22%, each have only a small influence upon the metals and are excellent in chemical stability in the presence of a flon.

The results are given in Table 5.

COMPARATIVE EXAMPLE 3

The same procedure as that of Example 3 was repeated except that samples (No. 13 to 17) listed in Table 5 were each used to determine the stability. It is apparent that these samples each exhibit a larger viscosity change and each have a greater influence upon the metals than those of Example 3.

The results are given in Table 5.

TABLE 5

| Sample No. | Viscosity (40° C., cSt) before test | Viscosity (40° C., cSt) after test | Viscosity change % | Appearance (Gardner color scale) before test | Appearance (Gardner color scale) after test | Wt. change of metal pieces (mg/cm²) steel | copper | aluminum |
|---|---|---|---|---|---|---|---|---|
| 1 | 10.6 | 9.5 | −10 | pale yellow transparent (1) | yellow transparent (3) | +0.08 | +0.06 | +0.08 |
| 2 | 35 | 28 | −20 | pale yellow transparent (1) | yellow transparent (4) | +0.11 | +0.05 | +0.06 |
| 4 | 37 | 29 | −22 | pale yellow transparent (1) | yellow transparent (4) | +0.10 | +0.06 | +0.07 |
| 13 | 34 | 16 | −53 | pale yellow transparent (1) | brown transparent (11) | −8.6 | −3.8 | −1.3 |
| 14 | 16 | 7 | −56 | pale yellow transparent (1) | brown transparent (9) | −7.3 | −3.6 | −1.2 |
| 15 | 73 | 24 | −67 | pale yellow transparent (1) | brown transparent (10) | −7.8 | −3.4 | −1.2 |
| 16 | 61 | 21 | −66 | pale yellow transparent (1) | brown transparent (8) | −6.9 | −2.8 | −0.8 |
| 17 | 61 | 22 | −64 | pale yellow transparent (1) | brown transparent (8) | −7.6 | −2.9 | −1.0 |

What is claimed is:

1. A refrigerant composition comprising a compound of formula (1) having a kinematic viscosity of 6 to 500 cSt at 40° C.:

$$C_mH_{2m+1}O(CH_2\overset{\overset{CH_3}{|}}{C}HO)_p(CH_2CH_2O)_q(CH_2O)_rC_nH_{2n+1}, \quad (1)$$

wherein m is an integer of 1–8, n is an integer of 1–8, p is an integer of 1–80, q is an integer of 0–60 and r is 0 or 1, with the provisos that $$2 \leqq m + n \leqq 9 \text{ and } -8 < m + n - \frac{20 \times q}{p + q} < 4,$$

and 1,1,1,2-tetrafluoroethane in a weight ratio of from 1:99 to 99:1.

2. A refrigerant composition according to claim 1, wherein said compound is $$CH_3O(CH_2\overset{\overset{CH_3}{|}}{C}HO)_7CH_3.$$

3. A refrigerant composition according to claim 1, wherein said compound is $$CH_3O(CH_2\overset{\overset{CH_3}{|}}{C}HO)_{17}CH_3.$$

4. A refrigerant composition according to claim 1, wherein said compound is $$CH_3O(CH_2\overset{\overset{CH_3}{|}}{C}HO)_{69}CH_3.$$

5. A refrigerant composition according to claim 1, wherein said compound is $$CH_3\overset{\overset{CH_3}{|}}{C}HO(CH_2\overset{\overset{CH_3}{|}}{C}HO)_{17}CH_3.$$

6. A refrigerant composition according to claim 1, wherein said compound is $$CH_3CH_2CH_2CH_2O(CH_2\overset{\overset{CH_3}{|}}{C}HO)_8(CH_2CH_2O)_{11}CH_3.$$

7. A refrigerant composition according to claim 1, wherein said compound is $$CH_3O(CH_2CH_2O)_5(CH_2\overset{\overset{CH_3}{|}}{C}HO)_{30}(CH_2CH_2O)_5CH_3.$$

8. A refrigerant composition according to claim 1, wherein said compound is $$CH_3CH_2CH_2CH_2\overset{\overset{CH_2CH_3}{|}}{C}HCH_2O(CH_2\overset{\overset{CH_3}{|}}{C}HO)_{15}(CH_2CH_2O)_{15}CH_3.$$

9. A refrigerant composition according to claim 1, wherein said compound is $$CH_3CH_2O(CH_2\overset{\overset{CH_3}{|}}{C}HO)_{10}(CH_2CH_2O)_{10}(CH_2O)CH_2CH_3.$$

10. A method of making a refrigerant composition comprising the step of combining 1,1,1,2-tetrafluoroethane and a compound of formula (1) having a kinematic viscosity of 6 to 500 cSt at 40° C.:

$$C_mH_{2m+1}O(\overset{\overset{\displaystyle CH_3}{|}}{CH_2CHO})_p(CH_2CH_2O)_q(CH_2O)_rC_nH_{2n+1}, \quad (1)$$

wherein m is an integer of 1–8, n is an integer of 1–8, p is an integer of 1–80, q is an integer of 0–60 and r is 0 or 1, with the provisos that $$2 \leqq m + n \leqq 1 \text{ and } -8 < m + n - \frac{20 \times q}{p + q} < 4,$$

in a weight ratio of from 1:99 to 99:1.

* * * * *

Adverse Decision In Interference

Patent No. 5,032,305, Tamiji Kamakura, Yuzi Baba, Kimiyoshi Namiwa, LUBRICANT FOR REFRIGERANT, Interference No. 103,289, final judgment adverse to the patentees rendered August 29, 1996, as to claims 1-10.

*(Official Gazette August 14, 2001)*